US010253650B2

(12) United States Patent
Müller et al.

(10) Patent No.: US 10,253,650 B2
(45) Date of Patent: Apr. 9, 2019

(54) DEVICE FOR INSTALLING AND REMOVING A COMPONENT ON A GAS TURBINE

(71) Applicant: Siemens Aktiengesellschaft, Munich (DE)

(72) Inventors: Dirk Müller, Mülheim a.d. Ruhr (DE); Christian Kowalzik, Berlin (DE); Ismail Belkahla, Recklinghausen (DE)

(73) Assignee: Siemens Aktiengesellschaft, Munich (DE)

( * ) Notice: Subject to any disclaimer, the term of this patent is extended or adjusted under 35 U.S.C. 154(b) by 89 days.

(21) Appl. No.: 15/505,179

(22) PCT Filed: Aug. 24, 2015

(86) PCT No.: PCT/EP2015/069319
§ 371 (c)(1),
(2) Date: Feb. 20, 2017

(87) PCT Pub. No.: WO2016/030312
PCT Pub. Date: Mar. 3, 2016

(65) Prior Publication Data

US 2017/0268382 A1 Sep. 21, 2017

(30) Foreign Application Priority Data

Aug. 26, 2014 (EP) ..... 14182306

(51) Int. Cl.
*F01D 25/28* (2006.01)
*F23R 3/60* (2006.01)
*F01D 25/24* (2006.01)

(52) U.S. Cl.
CPC ..... *F01D 25/285* (2013.01); *F01D 25/24* (2013.01); *F23R 3/60* (2013.01); *F05D 2220/32* (2013.01);
(Continued)

(58) Field of Classification Search
CPC ..... F01D 25/285; F23R 3/60; F23R 3/283; F23R 2900/00017; F23R 2900/00019;
(Continued)

(56) References Cited

U.S. PATENT DOCUMENTS 2,377,397 A * 6/1945 Booth ..... F16B 25/0015 292/340
9,404,390 B2 * 8/2016 Griese ..... F01D 25/285
(Continued)

FOREIGN PATENT DOCUMENTS

EP 2236939 A1 10/2010
WO 2013030230 A2 3/2013
WO WO 2013098028 A1 * 7/2013 ..... B25B 27/06

OTHER PUBLICATIONS

EP Search Report dated May 4, 2015, for EP patent application No. 14182306.2.
(Continued)

*Primary Examiner* — Todd E Manahan
*Assistant Examiner* — Thuyhang Nguyen
(74) *Attorney, Agent, or Firm* — Beusse Wolter Sanks & Maire

(57) ABSTRACT

The invention relates to a device for installing and removing a component on a gas turbine, having a rail system on which in particular a rotor can be displaced along a predetermined displacement axis, and having a terminal positioning part which is fixedly connected to the rail system. The positioning part has at least one guide portion which is designed to co-operate mechanically with a respective counterpart guide portion on the housing of the gas turbine, in order to achieve a suitable orientation of the device with respect to the housing of the gas turbine. The positioning part also has at least one connecting section which is designed in each case to form a fixed but releasable connection to a respective
(Continued)

counterpart connecting section on the housing of the gas turbine construct.

17 Claims, 4 Drawing Sheets

(52) U.S. Cl.
CPC ..... *F05D 2230/64* (2013.01); *F05D 2230/68* (2013.01); *F23R 2900/00017* (2013.01); *F23R 2900/00019* (2013.01); *Y10T 29/5383* (2015.01); *Y10T 29/53761* (2015.01); *Y10T 29/53848* (2015.01); *Y10T 29/53852* (2015.01)

(58) Field of Classification Search
CPC ..... F05D 2230/64; F05D 2230/644; F05D 2240/35; F02C 7/20; F02C 7/32; Y10T 29/53761; Y10T 29/5383; Y10T 29/53848; Y10T 29/53852; F05B 2220/704; F05B 2220/61; F05B 2220/70; F05B 2220/80
See application file for complete search history.

(56) References Cited

U.S. PATENT DOCUMENTS

| | | | | |
|---|---|---|---|---|
| 9,512,723 | B2 * | 12/2016 | Muller | B25B 27/06 |
| 2005/0076490 | A1 | 4/2005 | Kemsley et al. | |
| 2014/0087907 | A1 * | 3/2014 | Coffin | F16H 57/0479 475/159 |
| 2014/0215800 | A1 | 8/2014 | Mueller et al. | |

OTHER PUBLICATIONS

International Search Report dated Nov. 18, 2015, for PCT patent application No. PCT/EP2015/069319.

* cited by examiner

DEVICE FOR INSTALLING AND REMOVING A COMPONENT ON A GAS TURBINE

CROSS REFERENCE TO RELATED APPLICATIONS

This application is the US National Stage of International Application No. PCT/EP2015/069319 filed Aug. 24, 2015, and claims the benefit thereof. The International Application claims the benefit of European Application No. EP14182306 filed Aug. 26, 2014. All of the applications are incorporated by reference herein in their entirety.

FIELD OF INVENTION

The present invention relates to a device for installing and removing a component on a gas turbine, comprising a rail system on which in particular a runner can be displaced along a predefined displacement axis.

BACKGROUND OF INVENTION

In the context of gas turbine maintenance, it is sometimes necessary to replace components such as burners or transition pieces. The components are typically attached by means of a component flange to a matching component mating flange, for example on the casing of the gas turbine. Thus, for example a burner is connected by means of a burner flange to a matching burner mating flange, and attached to the casing of the gas turbine. In order to replace the component, the connections of the flange or of the mating flange must be released and the component as a whole must be removed. During this work, the available maintenance spaces can be very small since a great number of lines, pipes and cables in the region of the casing can greatly restrict the space available for movement. In order to provide more space, it would be necessary to remove these lines, pipes or cables, which would however greatly increase the work involved in maintenance. If, as in the operational arrangement of the gas turbine, the components are arranged in the lower region of the gas turbine casing, the use of a hoist for carrying the load is very difficult since the typical load-bearing ropes or chains are blocked by the casing of the gas turbine itself. Equally, the use of a hoist can however already be restricted by the lines, pipes or cables to the point that there is very little space available for movement.

In order for example to avoid such drawbacks, the applicant has already proposed, in one of their patent applications, installing a linear rail system on the gas turbine which can support a burner as the component, in order to be able to install or remove the latter in a targeted manner. This linear rail system, described in WO 2013/030230 A2 has two tracks and is itself secured to another, second rail system on which it can be moved to the respective burner opening. In this context, the second rail system is designed as an endless circular track or a circular arc which is attached, in the region of the burner mating flange, to the casing of the gas turbine such that the first, linear rail system can be moved to each burner opening in a targeted manner.

Although the linear rail system known from the prior art permits flexible working, bringing the linear rail system into precise alignment with the burner opening proves to be disadvantageous and sometimes protracted. Owing to the ability of the prior art linear rail system to move on a circular track or on a circular arc, it is sometimes not readily possible for a component, which has been removed, to be aligned with the casing of the gas turbine to the point that the component flange and the component mating flange can be connected to one another without further adjustment. However, post-adjustment can prove time-consuming.

Post-adjustment of this kind can be avoided in part if, for example, the rail system is screwed directly to the burner mating flange by means of an annular attachment flange, as taught for example in EP 2236939 A1. However, this still requires adjustment, specifically when the attachment flange is applied against the burner mating flange and at the same time the entire weight of the rail system has to be supported. Only once the flange and the mating flange are connected sufficiently securely is the adjustment finished.

The adjustment can be simplified by means of holes or bolts which are provided in the annular attachment flange of the rail system and can easily be aligned with suitable mating fitting regions on the burner mating flange. Adjustment aids of this type are disclosed for example in US 2005/0076490 A1.

However, adjustment aids of this type have the drawback that the operator cannot perform an easily detectable visual adjustment during application. The annular form of the attachment flange means that it can be applied against the burner mating flange in innumerable ways. In this context, the annular shape itself permits no orienting during the alignment procedure, rather the adjustment can be properly undertaken only when the flange and mating flange are already very close to one another or are in contact with one another. Even then, it may be necessary to re-orient, which is not always easy to carry out due to the considerable weight of the rail system.

SUMMARY OF INVENTION

It is therefore technically necessary to propose a suitable device for installing and removing a component on a gas turbine, which can avoid the drawbacks known from the prior art. In particular, the device should permit easy positioning of a rail system without having to post-adjust, and good visual orientation for alignment should be provided even during operation. In addition, the rail system should permit reliable and rapid alignment of the component flange and the component mating flange, in particular such that post-adjustment is no longer necessary. In this context, however, in order to be able to securely support a component, the device, which itself is normally relatively heavy, should be easy to handle and should be able to be attached to the casing of the gas turbine.

These objects upon which the invention is based are achieved with a device for installing and removing a component on a gas turbine, as claimed, and with a gas turbine having a corresponding casing, as claimed.

In particular, the objects upon which the invention is based are achieved with a device for installing and removing a component on a gas turbine, comprising a rail system on which in particular a runner can be displaced along a predefined displacement axis, further comprising a terminal positioning part which is securely connected to the rail system, the positioning part comprises at least one guide section which is designed to mechanically cooperate with a respective mating guide section on the casing of the gas turbine in order to achieve a suitable orientation of the device on the casing of the gas turbine, and wherein the positioning part further comprises at least one connecting section which is designed in each case to establish a secure yet releasable connection with a respective mating connecting section on the casing of the gas turbine, and wherein the positioning part is designed as a connection plate and the connection plate is shaped such that it has two planar sections each in the form of a projection, on or in each of which there is provided one of the at least one guide section.

Furthermore, the objects upon which the invention is based are achieved with a gas turbine having a casing which has, adjacent to a burner mating flange, at least one mating guide section on the casing of the gas turbine, which section is designed to mechanically interact with a respective guide section of a device as presented above and below so as to orient the device relative to the casing of the gas turbine, and also comprising, adjacent to the burner mating flange, at least one mating connection section which is designed to establish a releasable yet secure connection with a respective connection section of a device as described above and below.

It is therefore provided, according to the invention, to provide a positioning part on the rail system such that the positioning part can be used to suitably align the rail system on the casing of the gas turbine. To that end, the positioning part has a guide section which cooperates with a suitable mating guide section on the casing of the gas turbine such that, when they interact as intended, they both achieve alignment of the rail system relative to the casing of the gas turbine and thus relative to the burner mating flange on the casing of the gas turbine.

Preferably, the guide section and the mating guide section serve merely to align the device and not to attach the device to the casing. In that regard, the guide section and the mating guide section are designed such that alignment is easily achieved. Once this alignment has been established, the positioning part permits, by means of a connection section, a secure connection to the casing of the gas turbine by securely but releasably connecting the connection section to a mating connection section on the casing of the gas turbine. Thus, once the rail system has been aligned relative to the casing of the gas turbine, the device can be connected to the casing of the gas turbine in order to install or remove the component. In that regard, the guide section and the connection section on the positioning part of the device for installing and removing a component are not identical. The two sections have different functions and actions. Although the guide device does make it possible to attach the positioning part to the casing of the gas turbine, it does not do so to the point of establishing a secure and releasable connection with the casing which would make it possible to support the weight of a predetermined component on the rail system solely by means of this connection and introduce this component into the casing of the gas turbine.

In other words, the positioning part provides two different functional sections with different purposes. While the guide section first permits easy alignment of the device for installing and removing a component on the gas turbine, the connection section serves to establish a secure yet releasable connection such that the weight of a component on the rail system can be supported by this connection, and the component can be introduced into the casing of the gas turbine.

The invention also provides that the positioning part is designed as a connection plate. The planar nature of a connection plate permits simple orientation of planar components relative to one another, and as a result the device for installing and removing a component can be rapidly placed against an also planar section of the casing of the gas turbine, and oriented. Furthermore, once a suitable connection between the connection section and the mating connection section has been established, the flat surface permits an advantageous introduction of force over a relatively large area of the device for installing and removing the component into or out of the casing of the gas turbine.

It is also provided, according to the invention, that the connection plate is shaped such that it has two planar sections each in the form of a projection, on or in which there is provided a guide section. In particular, exactly two such projections are provided. The relevant two planar sections are easily handled by the maintenance personnel and thus permit good positioning of the positioning part relative to the casing of the gas turbine. The easy handling of the respective planar sections also permits advantageous alignment of the guide section and the mating guide section, such that it is possible to ensure that work is quick and safe. The projections allow the operating personnel to find the orientation rapidly during handling of the device. In addition, the two planar sections are low in number, such that reliable alignment can also be achieved in a short time. In other words, the operating personnel can easily and rapidly find the correct orientation during the alignment procedure, and thus avoid a labor-intensive alignment procedure.

At this point, it should also be noted that of course the mating guide section and the mating connection section on the casing of the gas turbine also serve different functions. Also, the sections identified on the casing are not mutually identical.

It should also be noted that the connection between the positioning part and the rail system can be either direct or indirect. Thus, the positioning part can also be connected to the rail system via the intermediary of other components. A direct connection between the positioning part and the rail system is therefore not necessary.

According to one particularly preferred embodiment of the device according to the invention, it is provided that the at least one guide section is not suitable for establishing a secure connection. A secure connection in the sense of the embodiment is achieved once the device for installing and removing a component on a gas turbine can support both its own weight and the weight of a component that is to be replaced. Thus, the guide section serves merely for aligning the rail system relative to the casing of the gas turbine. This makes it possible to produce the guide section using simple mechanical constructions without this having to take into account the strength and load-bearing capacity of this section with regard to the intended use of the device. In particular, suitable geometric shapes can be provided for the guide section and the mating guide section, which permit simple and proper interaction of the two sections, such that the entire device for installing and removing a component can be achieved rapidly and without undesired adjustment work.

According to another preferred embodiment of the device according to the invention, it is provided that the at least one guide section is designed as a plug-connection section. A plug connection is in particular also achieved when the guide section and the mating guide section engage releasably in one another so as to permit mechanical alignment of the entire device relative to the casing. In this context, plug connections can preferably be designed with an exact fit such that, with no play between the guide section and the mating guide section, it is easy to precisely orient the device relative to the casing of the gas turbine. Furthermore, plug connections are particularly cost-effective to provide, for example in that a guide section in the form of a peg can be plugged into a suitable bore which serves as the mating guide section. Equally, the guide section can be designed as a bore and the mating guide section as a peg.

According to another preferred embodiment of the invention, it is provided that the rail system has, on the side opposite that provided for the runner, at least one attachment section to which a load-supporting element can be attached. A load-bearing element of this type can for example be a steel cable, but also a trolley which for example supports the load of the rail system and the component on the floor. The load-bearing element makes it possible to provide the rail system with an additional securing device in order to also be able to divert high forces which can for example act on the rail system in the event of improper handling. In addition, the load-bearing element can advantageously be used to advantageously support the device for installing and removing a component even when this device is for example separated from the casing of the gas turbine, in order for example to be attached to another location on the casing of the gas turbine. During this changeover, it is namely not possible to transfer loads from the rail system via the positioning part into the casing of the gas turbine.

According to one preferred embodiment of the invention, it is provided that the guide sections and/or the connection sections are designed as bores. A suitably shaped bolt or screw can in particular be guided through the respective bores in order to align the device for installing and removing the component, or also to attach it to the casing of the gas turbine. In this context, bores are easy to provide and can be oriented with great precision. This further improves the possibility for aligning the device for installing and removing the component.

According to one refinement of this concept, it can also be provided that the bores are spaced apart from one another such that they cannot be oriented for mutual connection using any two threads of a burner mating flange. In this context, the burner mating flange typically has a number of threads which are spaced equally apart from one another and by means of which suitable screws can be guided through the burner flange and screwed into the threads. According to the embodiment, the bores for the guide sections or the connection sections should not fit these threads. Rather, these threads are reserved for connecting the burner flange to the burner mating flange. This means that even these very delicate threads can no longer be damaged during maintenance work. This has been the case during maintenance work, when these threads have also served for attaching a rail system, in that in the event of improper handling of the rail system the threads for attaching the burner to the casing of the gas turbine can also be damaged. However, this leads to longer downtimes of the gas turbine since as a consequence it is no longer possible to ensure a secure connection between the burner and the casing of the gas turbine, and the affected threads have to be replaced or laboriously reworked.

According to another, also preferred embodiment of the invention, it is provided that the rail system comprises at least two mutually parallel rails. This makes it possible for a typically cylindrical component such as a burner not only to be comfortably supported but also to be mounted in a controlled manner since its weight can be transferred evenly to both rails.

It is provided, according to a first preferred embodiment of the gas turbine according to the invention, that the at least one mating guide section is designed as a guide bolt and the corresponding guide section is designed as a matching bore or recess. As already stated above, this embodiment permits particularly simple and cost-effective alignment of the device for installing and removing a component on the casing of the gas turbine.

Alternatively, it is also conceivable that the at least one guide section is designed as a guide bolt and the corresponding mating guide section is designed as a matching bore or recess. This embodiment also permits simple and reliable alignment of the device for installing and removing a component on the casing of the gas turbine.

According to another preferred embodiment of the invention, it is provided that the runner comprises a runner plate having a shaped section which can interact with a suitable mating shaped section of a component in a fitting manner to receive and to support. In this context, the runner plate can be detached from the runner, and is therefore interchangeable. By exchanging the runner plate as appropriate, it is thus possible for the device for installing and removing a component to be adapted in modular fashion to respective components. When handling a component, it is therefore necessary only to replace the shaped section, it being possible for the runner or the rail system to remain unchanged. According to the embodiment, the runner plates can be adapted such that it is possible to suitably support a burner or a transition piece, or any other component.

In the following, the invention is explained in detail with reference to individual figures. In this context, it is to be noted that the figures are to be understood as merely schematic, and cannot represent any limiting effect with respect to the enablement of the invention.

It is also to be noted that those technical features provided with identical reference signs are intended to have an identical technical effect. It is further to be noted that the technical features below are claimed in any combination with one another, provided that the combination can solve the problem upon which the invention is based.

DETAILED DESCRIPTION OF INVENTION

Figure 1:
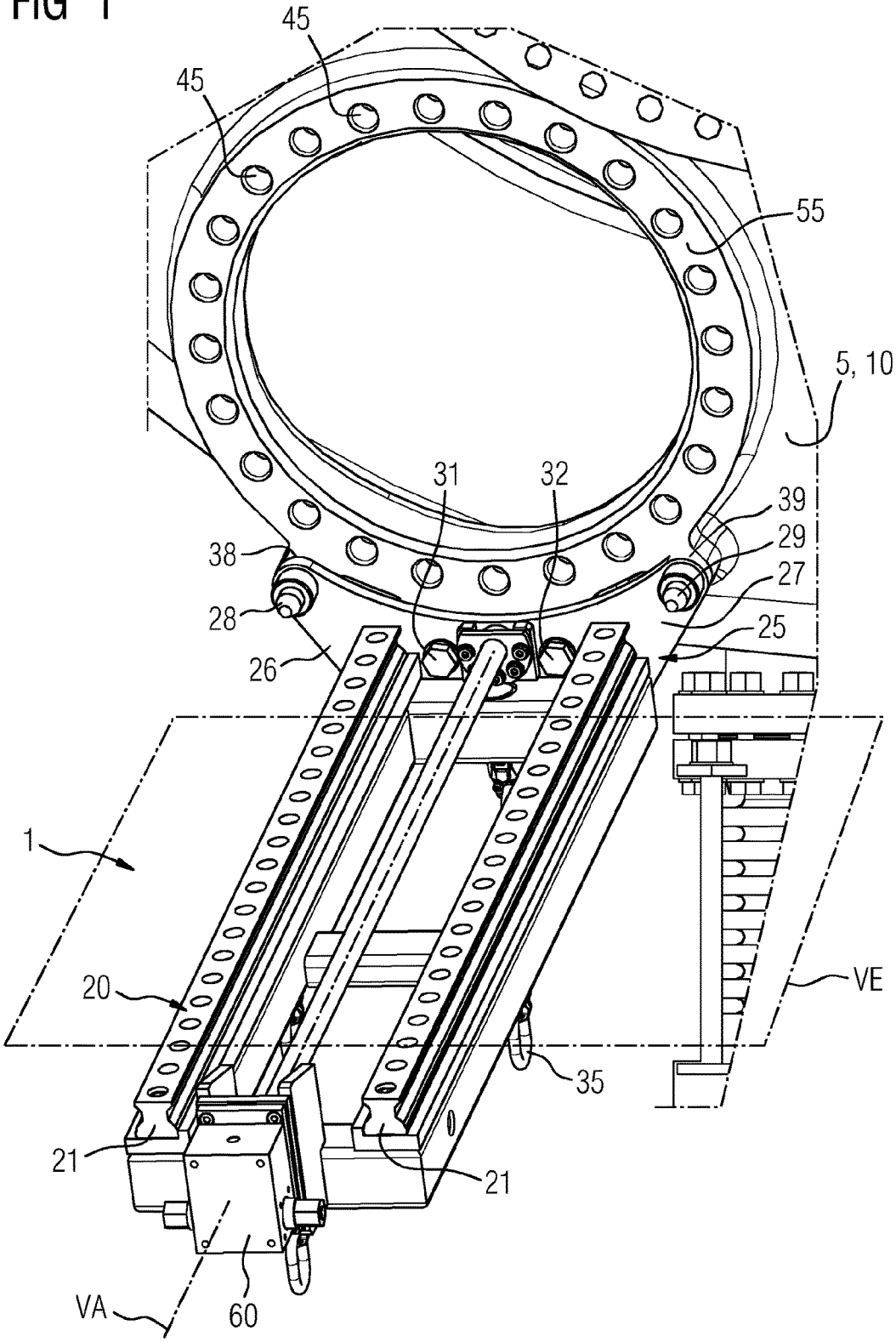
FIG. 1 is a perspective view of an embodiment of a device, according to the invention, for installing and removing a component, which has already been attached to the casing of a gas turbine.

FIG. 1 shows an embodiment of a device 1, according to the invention, for installing and removing a component 11 (not shown here) on a gas turbine 10. The device 1 is releasably attached to the casing 5 of the gas turbine 10.

In order to support the weight of a component 11 (not shown), the device 1 has a rail system 20 which comprises two mutually parallel rails 21. A runner 22 (not shown here) can be displaced on the rails 21 in question, along a displacement axis VA, such that the runner 22 in question can be moved back and forth normal to the plane defined by the burner mating flange. The plane which is defined by the two rails 21 and which contains the displacement axis VA defines a displacement plane VE. Displacement can be brought about in a controlled manner by means of a displacement adjustment unit 60.

The rail system 20 is connected to a positioning part 25, by means of which positioning part 25 it is in turn possible to establish a connection between the rail system 20 and the casing 5 of the gas turbine 10. The secure and releasable connection between the positioning part 25 and the casing 5 of the gas turbine 10 is established by means of two connection sections 31 and 32, wherein the connection sections 31, 32 in question are provided in the form of bores in the positioning part 25, itself in the form of a plate, through which bores two respective screws can be guided and screwed to the casing 5 of the gas turbine 10.

In order to align the rail system 20 on the casing 5 of the gas turbine 10, the positioning part 25 also has in each case one lateral guide section 28 and 29 which, in the present case, are also designed as bores in the positioning part that is in the form of a plate. In this context, the bores are provided in the lateral planar sections 26 and 27, which are designed as projections in the sense of an outward-projecting continuation of the planar positioning part. Suitable guide pegs, which constitute the mating guide sections 38 and 39, extend through the bores of the guide sections 28 and 29. In order to align the device 1 on the casing 5 of the gas turbine 10, these pegs are first inserted into the guide sections 28 and 29 in the form of bores, such that the rail system 20 can already be suitably oriented with respect to the burner opening that is defined by the burner mating flange 55. Once this orienting step is complete, the device 1 is screwed to the casing 5 of the gas turbine 10 with the aid of the screws in the region of the connection sections 31 and 32. In this context, it is to be noted that attachment of the device 1 in the region of the burner mating flange 55 is not effected using the threads 45 of the burner mating flange 55, but rather in the region of other threads that are not provided for attachment of the burner to the burner mating flange 55. These threads are provided in the manner of a mating connection section 41 and 42 in the region of the burner mating flange 55.

Figure 2:
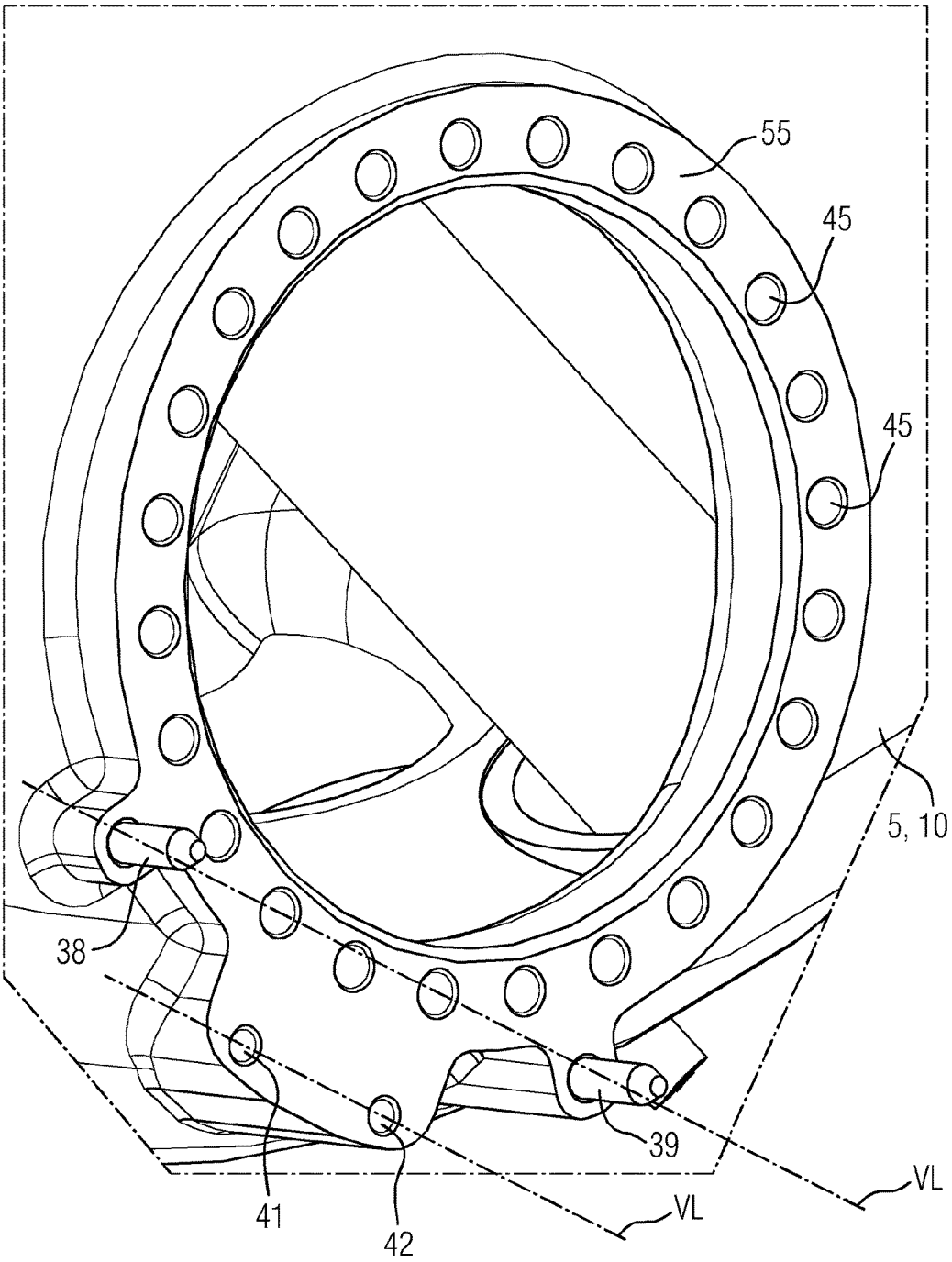
FIG. 2 is a perspective side view of an embodiment of a burner mating flange which is provided in one piece with two mating guide sections and two mating connection sections, as a component of the casing of a gas turbine.

FIG. 2 shows the region of the burner mating flange 55 in a perspective side view of an embodiment of the gas turbine 10, as shown by way of example in FIG. 1. The figure shows clearly that the two mating guide sections 38 and 39 are designed as pegs which, for alignment, project through the guide sections 28 and 29, designed as bores, of the device 1. However, in order to establish a strong connection between the device 1 and the casing 5 of the gas turbine 10, the device 1 is screwed, with the aid of the previously mentioned screws, into the two mating connection sections 41 and 42 that are designed as threads. By virtue of this attachment, the device 1 can be attached to the gas turbine sufficiently securely for supporting a component and for precise alignment. It is at the same time possible to avoid the threads 45 of the burner mating flange 55 being damaged, for example by improper use of the device 1.

Both the mating guide sections 38 and 39 and the two mating connection sections 41 and 42 are made in one piece together with the component of the burner mating flange 55. This makes it possible to achieve precise orientation of the mating guide sections 38 and 39 and of the mating connection sections 41 and 42 relative to one another or relative to the threads 45 of the burner mating flange.

In order for the weight of the component 11 that is to be supported (not shown here) to be sufficiently securely supported on the burner mating flange 55, and to transfer the support forces thereto, the two mating guide sections 38 and 39, and respectively the mating connection sections 41 and 42, are provided in mirror image to one another along a respective connecting line VL.

Figure 3:
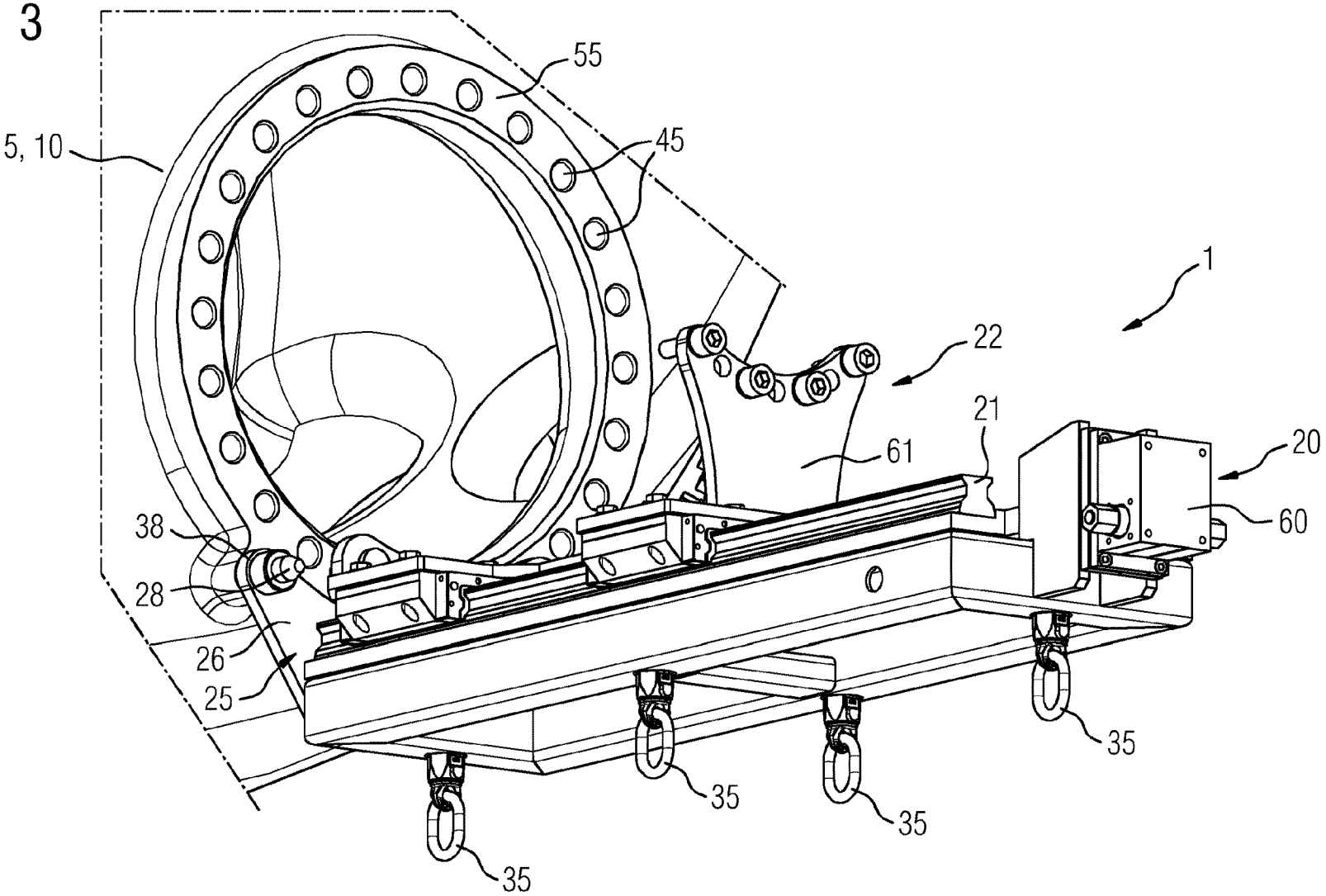
FIG. 3 is a perspective view of an embodiment of a device, according to the invention, for installing and removing a component, which has already been attached to the casing of a gas turbine, as for example already illustrated in FIG. 1.

FIG. 3 shows the device 1, already illustrated in FIG. 1, in a perspective side view from below, there being provided a total of 4 attachment sections 35 on the opposite side of the rail system 20 from the runner 22, to which a load-supporting element can be attached. In this context, the attachment sections 35 are in the form of metal eyes through which for example a load-bearing steel cable can run in order to support the device 1 for extra security. The attachment sections 35 are used primarily when, once a component has been installed or removed at one burner mating flange 55, the device 1 has to be moved to another burner mating flange 55 of the gas turbine 10.

Figure 4:
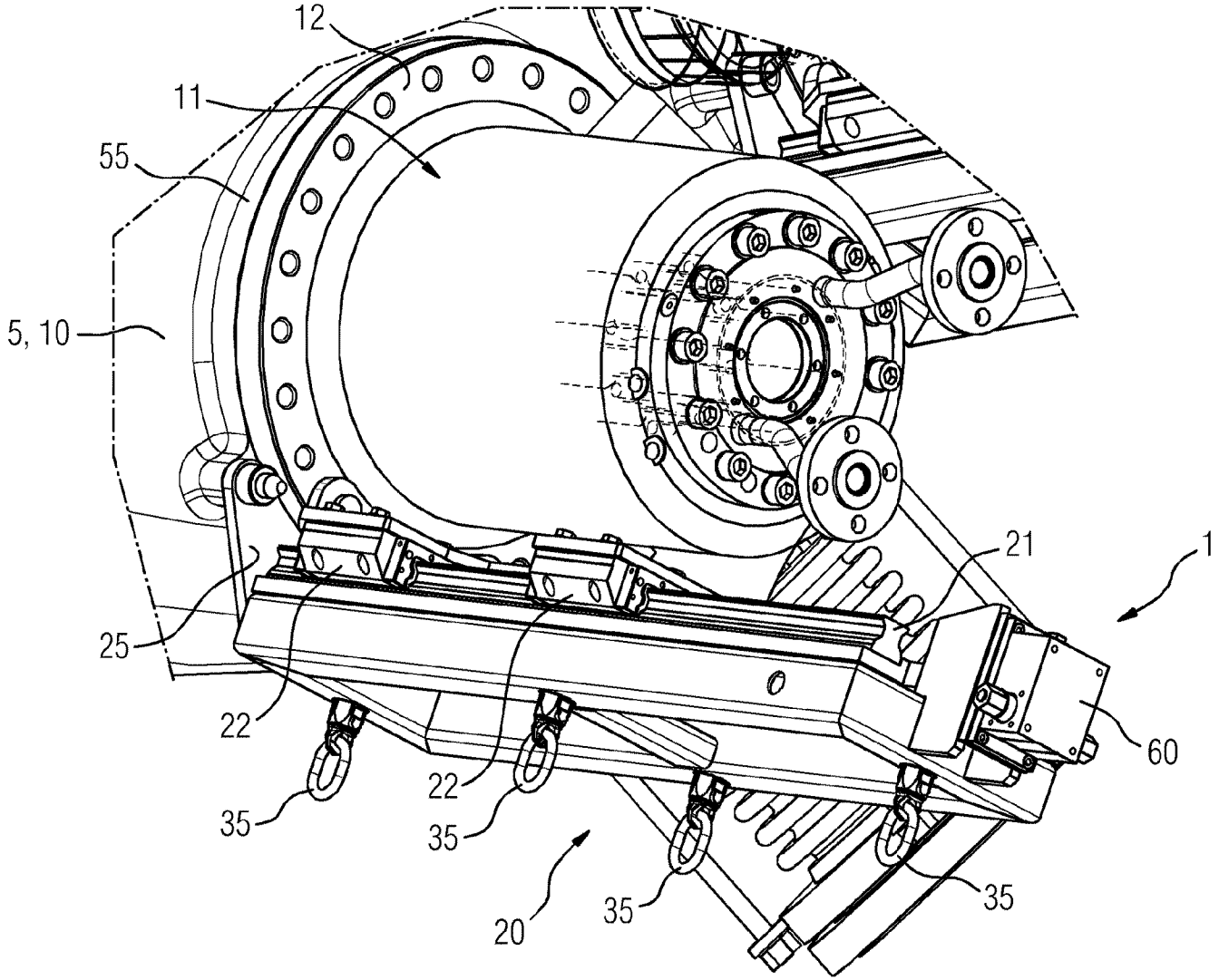
FIG. 4 is a perspective view of an embodiment of a device, according to the invention, for installing and removing a component, as already illustrated in FIGS. 1 and 3, with the difference that this device supports a component.

FIG. 4 shows a side view of an embodiment of the device 1 according to the invention, or an embodiment of the gas turbine 10 according to the invention, in which however a component 11 in the form of a burner is supported by the rail system 20 and has already been correctly aligned, for installation, with the casing 5 of the gas turbine. For alignment, the burner flange 12 is oriented relative to the matching burner mating flange 55 such that the bores on the burner flange 12 line up with the no longer visible threads 45 of the burner mating flange 55, and can then be screwed using suitable screws.

Further embodiments are to be found in the subclaims.

The invention claimed is:

1. A gas turbine comprising:

a rail system comprising rails on which a runner is displaceable along a predefined displacement axis, and a terminal positioning part which is securely connected to the rail system, the rail system and the terminal positioning, part are parts of a device, the terminal positioning part comprises at least two guide sections, each of which is designed to mechanically cooperate with a respective mating guide section of at least two mating guide sections on a casing of the gas turbine in order to achieve a suitable orientation of the device on the casing of the gas turbine, and wherein the terminal positioning part further comprises at least one connection section designed to establish a secure vet releasable connection with a respective mating connection section on the casing of the gas turbine, wherein the terminal positioning part is designed as a connection plate comprising two planar sections each in a form of a projection, each projection comprising: a respective guide section of the at least two guide sections, wherein the casing comprises a burner mating flange configured to secure a component to the casing at the burner mating flange, and the casing comprising: the at least two mating guide sections which are disposed radially outside of the burner mating flange, wherein each of the at least two mating guide sections is designed to mechanically interact with a respective guide section of the at least two guide sections to orient the device relative to the casing of the gas turbine; and the respective mating connection section which is disposed radially outside of the burner mating flange and designed to establish the releasable yet secure connection with the at least one connection section, wherein each mating guide section comprises a guide body that is immovably integral to the casing and that protrudes from the casing, and wherein each mating connection section comprises a connection body that is immovably integral to the casing and that protrudes from the casing, and wherein the guide body and the connection body are immovable relative to each other, wherein the connection plate is immovably secured directly to the connection body hut not to the burner mating flange, and the at least two guide sections and the at least one connection section are configured to be positioned radially outside of the burner mating flange when the connection plate is directly secured to the connection body, wherein each guide section of the at least two guide sections mechanically cooperates with a respective mating guide section of the at least two mating guide sections via a respective guide arrangement, wherein each respective guide arrangement comprises a bore and an unthreaded stud that slides into the bore via axial movement alone and in a fit that properly aligns the device on the casing before the connection plate is secured to directly the connection body, and wherein each respective guide section comprises either the stud or the bore, and wherein for each mating guide section: when the respective guide section comprises the bore the mating guide section comprises the stud, and when the respective guide section comprises the stud the mating guide section comprises the bore.

2. The gas turbine as claimed in claim 1, wherein the rail system comprises, on a side opposite of a side that provided for the runner, at least one attachment section configured to attach to a load-supporting element.

3. The gas turbine as claimed in claim 1, wherein the at least two guide sections and the at least one connection section are designed as bores.

4. The gas turbine as claimed in claim 3, wherein the bores are spaced apart from one another such that the bores cannot be oriented for mutual connection using any two threads of the burner mating flange.

5. The gas turbine as claimed in claim 1, wherein the rail system comprises at least two mutually parallel rails.

6. The gas turbine as claimed in claim 1, wherein at least one mating guide section of the at least two mating guide sections comprises the stud and the respective guide section comprises the bore.

7. The gas turbine as claimed in claim 1, wherein at least one mating guide section of the at least two mating guide sections comprises the bore and the respective guide section comprises the stud.

8. The gas turbine as claimed in claim 1, wherein the runner comprises a runner plate comprising a shaped section which can interact with a suitable mating shaped section of the component in a fitting manner to receive and to support.

9. The gas turbine as claimed in claim 1, wherein the stud comprises an unthreaded peg.

10. The gas turbine as claimed in claim 1, wherein each mating guide section of the at least two mating guide sections comprises the stud, and wherein respective guide sections each comprise the bore.

11. The gas turbine as claimed in claim 1, wherein the burner mating flange comprises an array of bolt holes, each comprising a thread configured to receive a screw, wherein the bore does not fit the thread.

12. The gas turbine as claimed in claim 1, wherein the bores are spaced so that the terminal positioning part cannot be connected to the burner mating flange.

13. The gas turbine as claimed in claim 1, wherein the component comprises a burner.

14. The device as claimed in claim 1, wherein the at least two guide sections are spaced so that the at least two guide sections cannot be connected to the burner mating flange.

15. An arrangement, comprising:

a casing comprising: a mating flange configured to secure a component; at least two mating guide sections which are disposed radially outside of the mating flange; and a mating connection section disposed radially outside of the mating flange; wherein each mating guide section comprises a guide body that is immovably integral to the casing and that protrudes from the casing, and wherein each mating connection section comprises a connection body that is immovably integral to the casing and that protrudes from the casing, and wherein the guide body and the connection body are immovable relative to each other;

a rail system on which a runner s displaceable along a predefined displacement axis;

a terminal positioning part which is securely connected to the rail system, the terminal positioning part comprises: at least two guide sections, each of which is designed to mechanically cooperate with a respective mating guide section of the at least two mating guide sections; and at least one connection section designed to establish a secure yet releasable connection with a respective mating connection section;

wherein the terminal positioning part is designed as a connection plate comprising two planar sections each in a form of a projection, each projection comprising a respective guide section of the at least two guide sections;

wherein the connection plate is immovably secured directly to the connection body but not secured directly to the mating flange, and the at least two guide sections and the at least one connection section are configured to be positioned radially outside of the mating flange;

wherein each respective guide section mechanically cooperates with each respective mating guide section via a respective guide arrangement, wherein each respective guide arrangement comprises a bore and a stud that slides into the bore via axial movement alone and in a fit that properly aligns the component on the casing before the connection plate is secured to directly the connection body, and wherein each respective guide section comprises either the stud the bore, and wherein for each mating guide section when the respective guide section comprises the bore the mating guide section comprises the stud, and when the respective guide section comprises the stud the mating guide section comprises the bore.

16. The arrangement of claim 15, wherein the mating flange is a burner mating flange, and wherein the component is a burner.

17. A mounting arrangement, comprising:

a gas turbine engine combustion section outer casing comprising a burner mount comprising a burner flange surrounding a burner opening through the combustion section outer casing, the burner flange configured to secure a burner to the burner mount;

a connection body protruding from and immovable relative to the combustion section outer casing and disposed adjacent and radially outside the burner flange with respect to the burner opening;

a mounting device comprising: a rail system comprising rails on which a runner translates, the runner configured to secure the burner to the rails; and a connection plate connected to the rails; and a pattern of unthreaded alignment pins configured to align with a matching pattern of alignment bores only when the mounting device is positioned in a predetermined orientation relative to the burner mount, wherein once aligned alignment pins of the pattern of unthreaded alignment pins are advanced into alignment bores of the matching pattern of alignment bores via axial movement alone until the connection plate abuts the connection body, thereby enabling the connection plate to be immovably secured directly to the connection body, not secured directly to the burner flange, and positioned radially outside the burner flange when so secured.

* * * * *